US008333139B2

(12) United States Patent
Addis

(10) Patent No.: US 8,333,139 B2
(45) Date of Patent: Dec. 18, 2012

(54) SYSTEM FOR ATTACHING OR DETACHING FIREARM ACCESSORIES USING A CARTRIDGE CASE AND RIM CHANNEL

(76) Inventor: Michael A. Addis, Hayward, CA (US)

( * ) Notice: Subject to any disclaimer, the term of this patent is extended or adjusted under 35 U.S.C. 154(b) by 97 days.

(21) Appl. No.: 13/006,645

(22) Filed: Jan. 14, 2011

(65) Prior Publication Data

US 2012/0180352 A1 Jul. 19, 2012

(51) Int. Cl.
*F41A 21/00* (2006.01)

(52) U.S. Cl. ..... 89/14.05; 42/90; 42/75.02

(58) Field of Classification Search ..... 42/90, 75.01–75.03; 89/14.05
See application file for complete search history.

(56) References Cited

U.S. PATENT DOCUMENTS

| | | | | |
|---|---|---|---|---|
| 3,747,247 | A * | 7/1973 | McNair | 42/1.14 |
| 8,051,595 | B2 * | 11/2011 | Hochstrate et al. | 42/75.01 |
| 8,181,563 | B1 * | 5/2012 | Peterken | 89/191.01 |
| 2011/0168009 | A1 * | 7/2011 | Robb et al. | 89/194 |
| 2012/0111183 | A1 * | 5/2012 | Hochstrate et al. | 89/193 |

* cited by examiner

*Primary Examiner* — Michael David
(74) *Attorney, Agent, or Firm* — Kang S. Lim

(57) ABSTRACT

Systems and methods for using a cartridge case as a tool to install or remove firearm barrel attachments. The barrel attachment includes a channel for engaging a cartridge case rim. This rim channel provides mechanical leverage for rotating the barrel attachment around a bore axis of the firearm barrel. The rim channel may include a curved portion to increase the load-bearing contact area. The contact area between the rim of the cartridge case and the barrel attachment can be further increased by a half-moon insert.

20 Claims, 14 Drawing Sheets

SYSTEM FOR ATTACHING OR DETACHING FIREARM ACCESSORIES USING A CARTRIDGE CASE AND RIM CHANNEL

BACKGROUND

The present invention relates to systems and methods for using a firearm cartridge as a field tool to attach or detach firearm accessories, thereby eliminating the need for carrying a specialized tool such as a wrench.

Accessories for firearms have increased steadily over time in both functionality and flexibility, and today, there are many firearm accessories available including optics and barrel-mounted accessories such as muzzle brakes and flash suppressors. Many barrel-mounted accessories are attached to the barrel muzzle using screw threads or some other mechanical coupling system. Because all modern firearms are rifled for accuracy, whenever a firearm is fired, rotation impulse forces are generated and these forces have a tendency to tighten threaded muzzle accessories relative to the barrel. In addition, carbonization in muzzle accessories is inevitable from repeated exposure to hot gaseous propellant byproducts and over time such carbon deposits tend to "gum-up" attachment areas of these muzzle accessories.

To ensure proper reliable functioning, field maintenance of firearms have to be performed regularly. This involves field stripping and cleaning dirty components including muzzle accessories. Further, in the field, a user may decide to make reconfigure his/her firearm such as changing muzzle accessories, when the services of a gunsmith and/or gunsmithing tools are not available.

It is therefore apparent that an urgent need exists for systems and methods of using easily accessible and adaptable "tools", such as firearm cartridge cases, to maintain and reconfigure firearms in the field. Such improved equipment and techniques will enable a user to perform field maintenance and reconfiguration of his/her firearm without having to carry an extensive tool kit.

SUMMARY

To achieve the foregoing and in accordance with the present invention, systems and methods for using a cartridge case as a tool to install or remove firearm accessories such as barrel attachments.

In one embodiment, a barrel attachment includes a coupling section for attaching the barrel attachment to a firearm barrel. The barrel attachment also includes a rim channel for engaging a portion of the rim of a cartridge case. This rim channel provides mechanical leverage by enabling a user to apply force on the engaged cartridge case to rotate the barrel attachment around a bore axis of the firearm barrel, for the purpose of attaching or removing the barrel attachment.

In some embodiments, the rim channel is an integral portion of a cartridge rim slot machined into the exterior part of the barrel attachment, and the rim slot is substantially parallel to the bore axis. Ideally, the rim channel includes a curved portion corresponding to the radius of the cartridge rim to increase the load-bearing contact area whenever the rotation forces are applied to the cartridge case by the user. The rim channel can also be adapted to accept different case rim sizes.

In some embodiments, multiple rim slots are machined into the exterior of barrel attachment, allowing the user to spread out the forces amongst multiple cartridge cases. For example, two rim slots, located 180 degrees from each other, will allow the user to rotate the barrel attachment in a manner similar to using a T-handled wrench.

It is also possible to slide a half-moon insert into the rim slot thereby increasing the contact area between the rim of the cartridge case and the barrel attachment, and reducing the risk of deforming the cartridge rim. This half-moon insert can be further configured to provide impact forces to, for example, enable a police officer to break an automobile window during a hostage rescue mission.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Figure 1A:
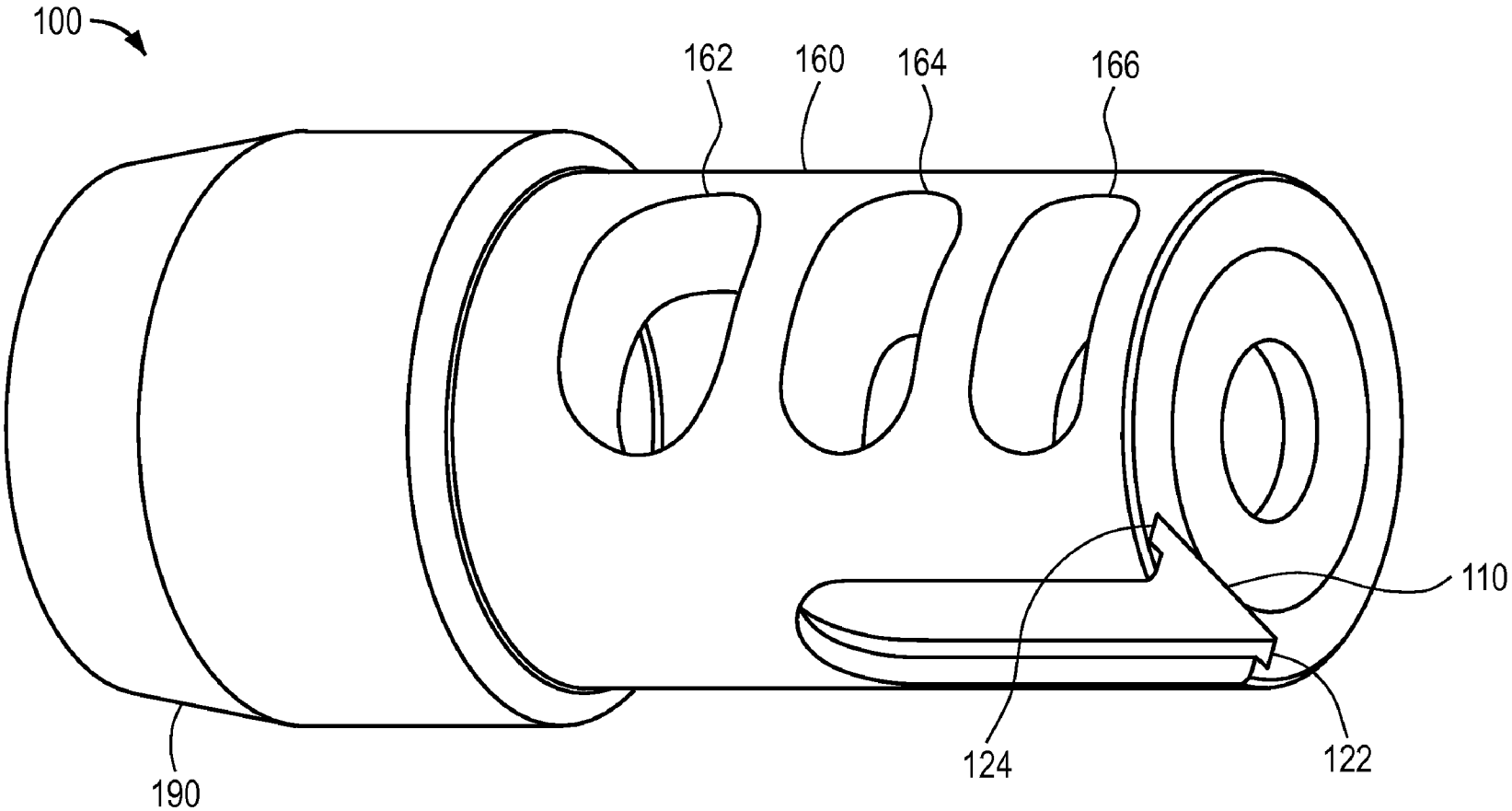
FIG. 1A is an isometric view of a barrel attachment with a rim channel configured to accept the rim of a firearm cartridge case, in accordance with one embodiment of the present invention.

The present invention relates to systems and methods for using a cartridge case to provide additional mechanical leverage for installing or removing a barrel attachment from a firearm barrel without the need for a specialized tool. To facilitate discussion, FIG. 1A shows an isometric view of a barrel attachment 100 in accordance with one embodiment of the present invention. Barrel attachment 100 includes an attachment body 160 and a coupling section 190 for securing the attachment 100 to a firearm barrel (not shown). In this example, attachment 100 functions as a muzzle brake with gas ports 162, 164 and 166. Barrel attachment 100 includes a case rim slot 110 having substantially parallel rim channel sections 122, 124 configured to accept the rim of a firearm cartridge case (not shown).

Figure 1B:
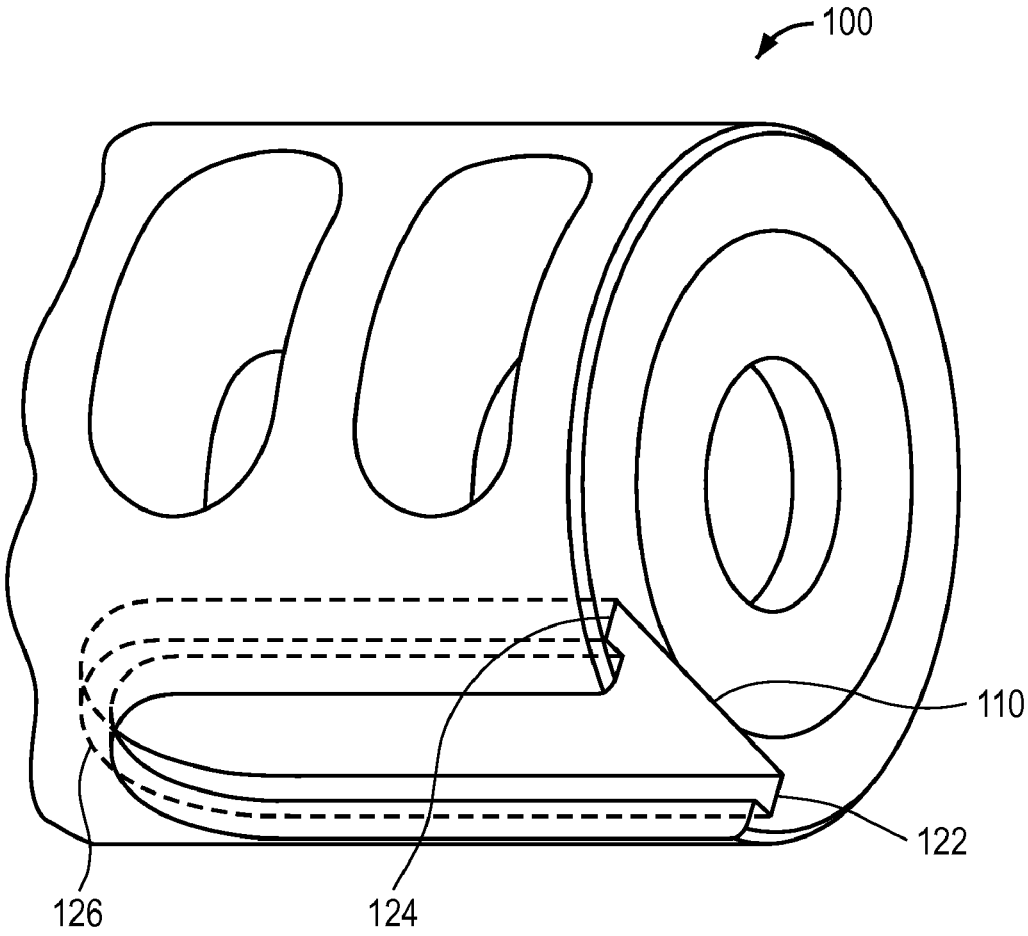
FIG. 1B is an enlarged view of the front portion of the embodiment of FIG. 1A showing the rim channel in greater detail together with hidden lines.
Figure 1C:
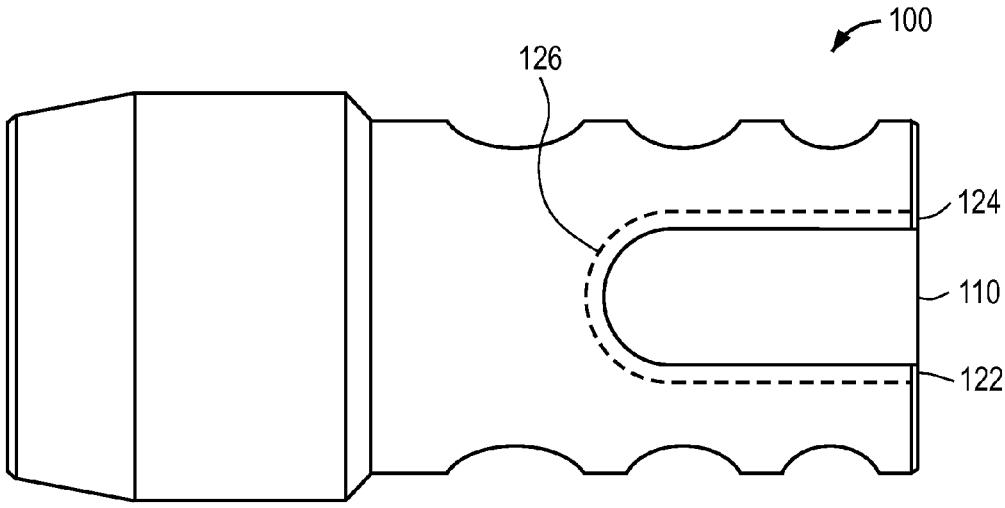
FIGS. 1C and 1D are bottom and side views of the embodiment of FIG. 1.
Figure 1D:
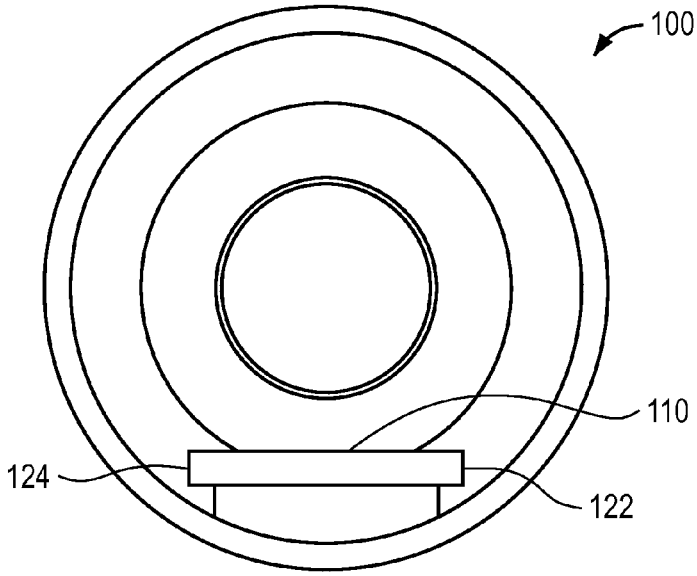

FIG. 1B is an enlarged view of the front portion of barrel attachment 100 showing rim slot 110 in greater detail together with hidden lines showing a curved rim channel section 126 adjacent to both rim channel sections 122, 124. To additional clarity for rim slot 110, FIGS. 1C and 1D provide bottom and side views of barrel attachment 100.

Figure 1E:
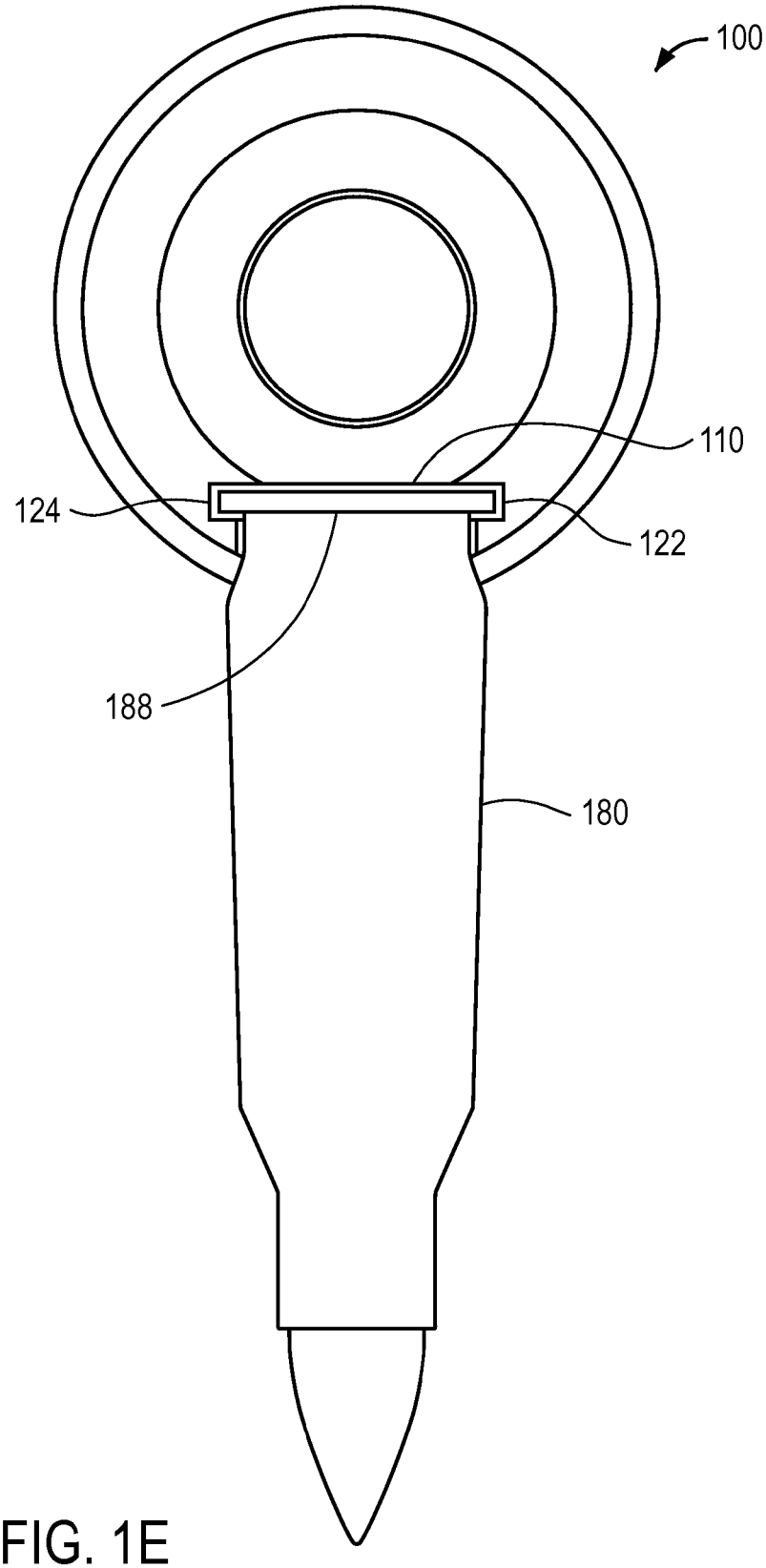
FIG. 1E is a front view showing an exemplary cartridge coupled to the embodiment of FIG. 1A.

Referring now to FIG. 1E, a front view of barrel attachment 100, a case rim 188 of an exemplary firearm cartridge 180 is inserted into rim slot 110, providing a user with mechanical leverage for rotating barrel attachment 100 substantially around the bore axis of a firearm barrel. The mechanical leverage enables the user to secure attachment 100 to a firearm barrel, or conversely, to remove attachment 100 from the firearm barrel without the need for an addition tool, such as a wrench. This ability to couple and decouple barrel attachments in the field without having to carry a specialized tool is highly advantageous for both field maintenance and reconfiguration, since live cartridges and/or fired cartridge cases are almost always available to the user. Conversely, during dry practice sessions, for safety reasons, often, only blank and/or inert cartridges are made available to the user.

Figure 2:
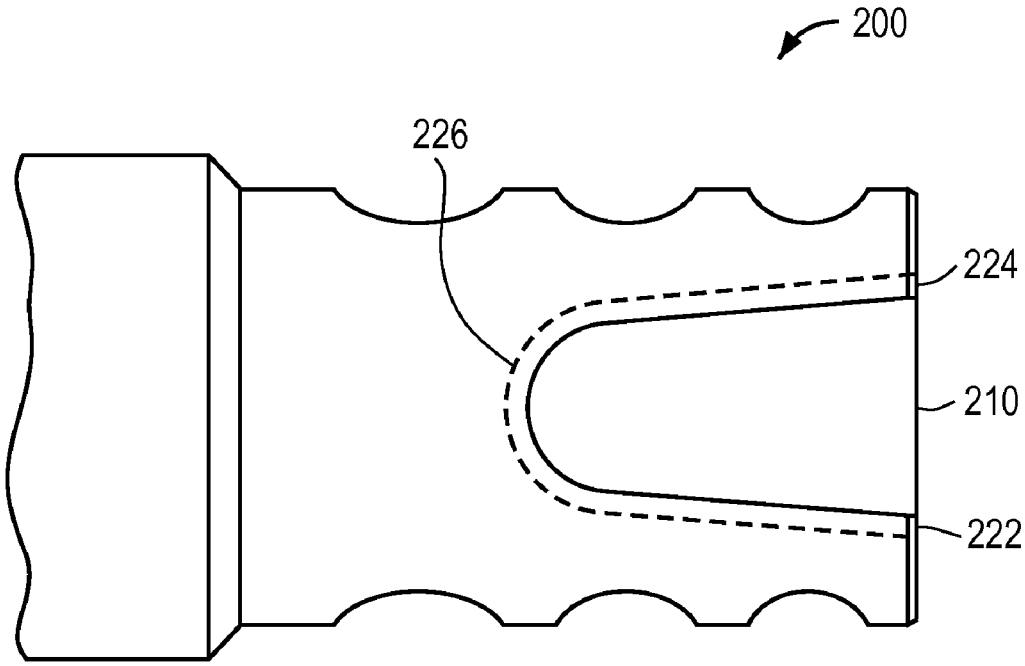
FIG. 2 shows another embodiment of the present invention configured to accept multiple cartridge sizes.

FIG. 2 is a bottom view of another embodiment, barrel attachment 200, with a multi-caliber rim slot 210 having rim channel sections 222, 224 substantially tapering towards a curved rim section 226, thereby enabling rim slot 210 to accept two or more cartridge rim sizes. This flexibility is especially advantageous amongst groups of users with different caliber firearms. For example, a group of sport shooting competitors may have a mixture of small and large caliber rifles. Similarly, law enforcement field teams in the U.S.A. are typically multi-caliber with 5.56×45 mm caliber select-fire carbines issued to most team members and the larger 7.62 mm caliber precision rifles issued to a couple of marksmen.

Accordingly, when equipped with barrel attachment 200, a user issued with a smaller 5.56 mm caliber firearm has the option to use a teammate's larger and longer 7.62 caliber cartridge capable of providing greater mechanical leverage for rotating barrel attachment 100. In this example, with such a flexible multi-caliber rim slot 210, it may also be possible to use cartridges with larger rims, associated with long-range firearms, team-operated firearms, and/or vehicle-mounted firearms, such as a 7.62×67 mm (.300 Win Mag) caliber cartridge, a 8.58×70 mm (.338 Lapua Mag) caliber cartridge, and/or a 12.7×99 mm (.50 BMG) caliber cartridge.

Figure 3A:
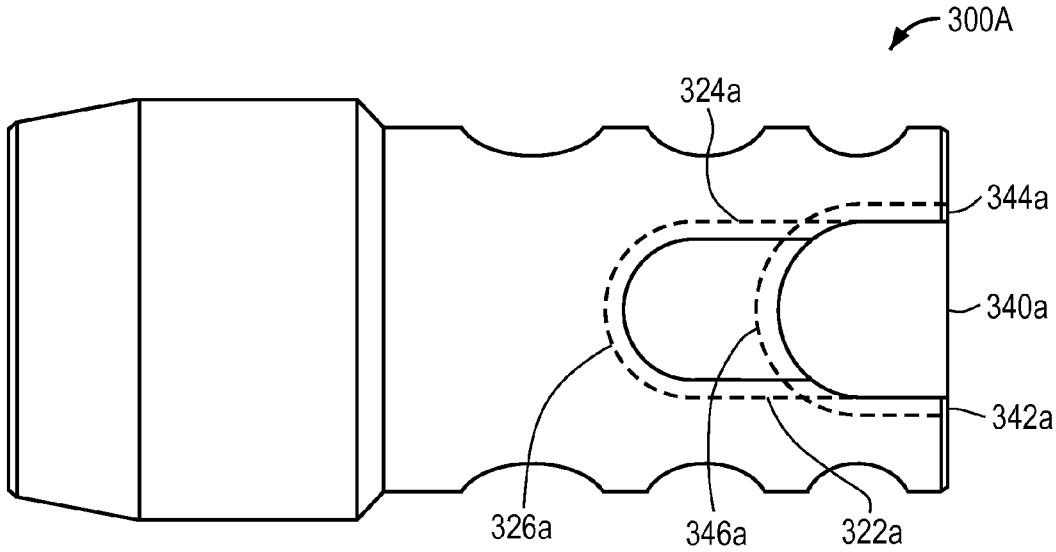
FIGS. 3A-B and FIGS. 3C-D are respective bottom and front views illustrating two additional embodiments configured to accept multiple cartridge sizes.
Figure 3B:
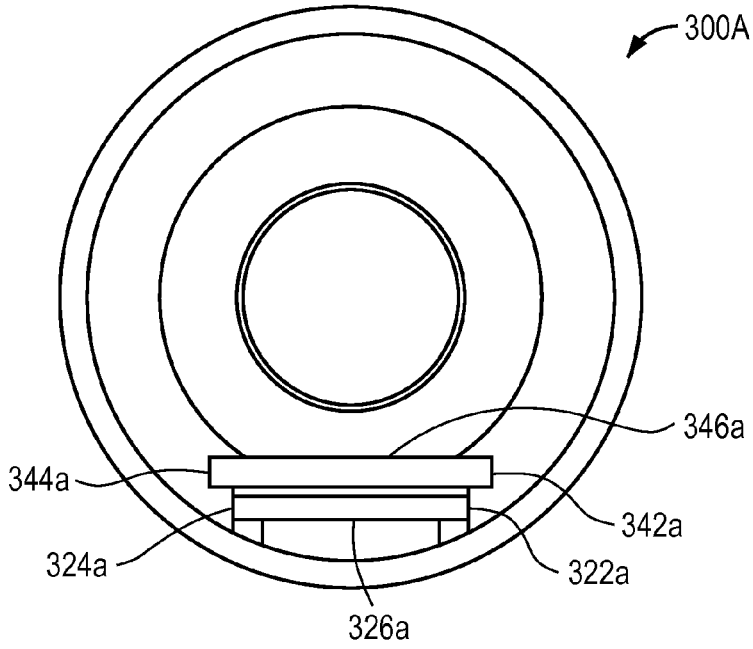

FIGS. 3A and 3B are the bottom and front views illustrating an additional embodiment, barrel attachment 300A, configured to accept dual cartridge rim sizes. Barrel attachment 300A includes a narrower caliber rim slot, having a curved rim channel section 326*a* adjacent to rim channel sections 322*a*, 324*a*, configured to accept a cartridge (not shown) with a smaller rim. Attachment 300A also includes a wider caliber recessed rim slot 340*a*, having a curved rim channel section 346*a* adjacent to rim channel sections 342*a*, 344*a*, configured to accept a cartridge (not shown) with a larger rim.

Figure 3C:
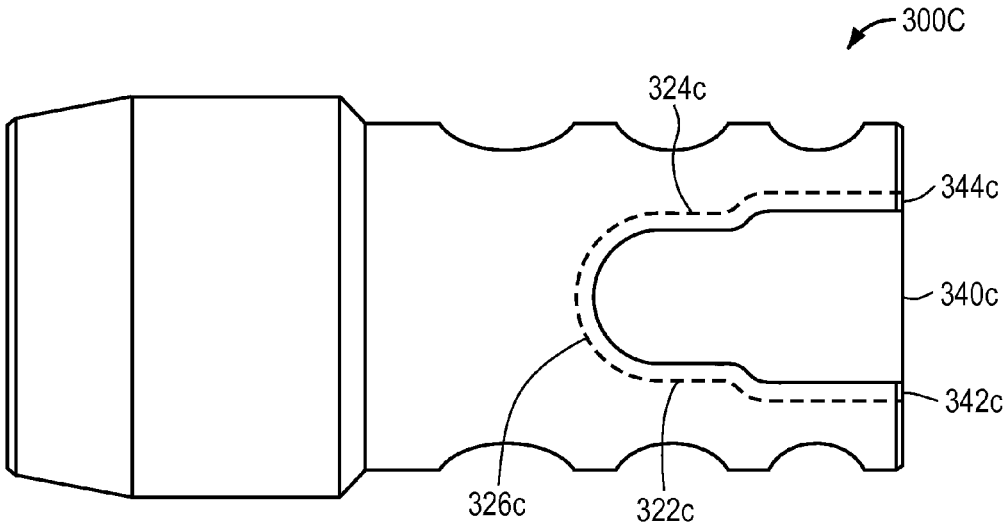
Figure 3D:
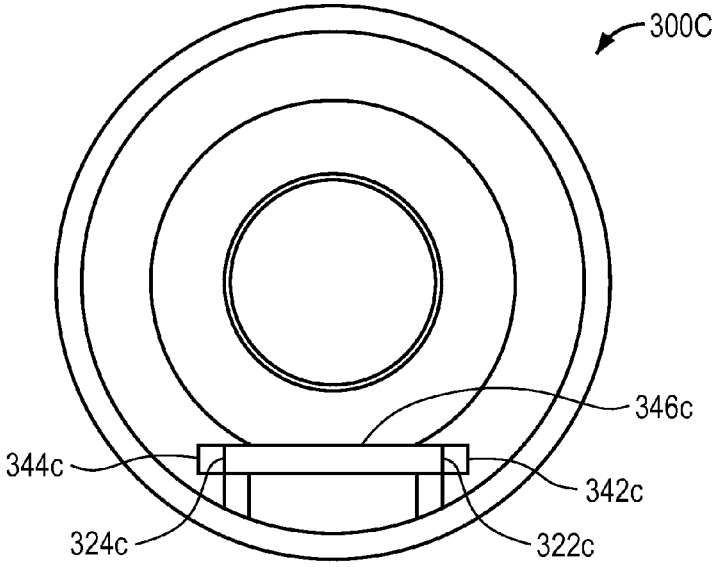

FIGS. 3C and 3D are the bottom and front views illustrating yet another embodiment, barrel attachment 300C, configured to accept dual cartridge rim sizes. Barrel attachment 300C includes a dual cartridge rim slot 340*c*, having a curved rim channel section 326*c* adjacent to rim channel sections 322*c*, 324*c*, configured to accept a cartridge (not shown) with a smaller rim. Dual cartridge rim slot 340*c* also includes a rim channel section 342*c* and an opposing rim channel section 344*c*, configured to accept a cartridge (not shown) with a larger rim.

Although exemplary barrel attachments 300A and 300C are each configured to accept two cartridge rim sizes, it is contemplated that barrel attachments can be configured to accept, for example, a three or more cartridge rim sizes. It is also contemplated that barrel attachments with multiple rim capability, e.g., attachments 200, 300A and 300C, can be configured to accept a wide variety of cartridge case designs incorporating a rim, including "rimmed" (protruding rim) cartridges, "rimless" (recessed or non-protruding rim) cartridges, straight-wall cartridges, and/or tapered cartridges such as bottle-neck cartridges.

Figure 4A:
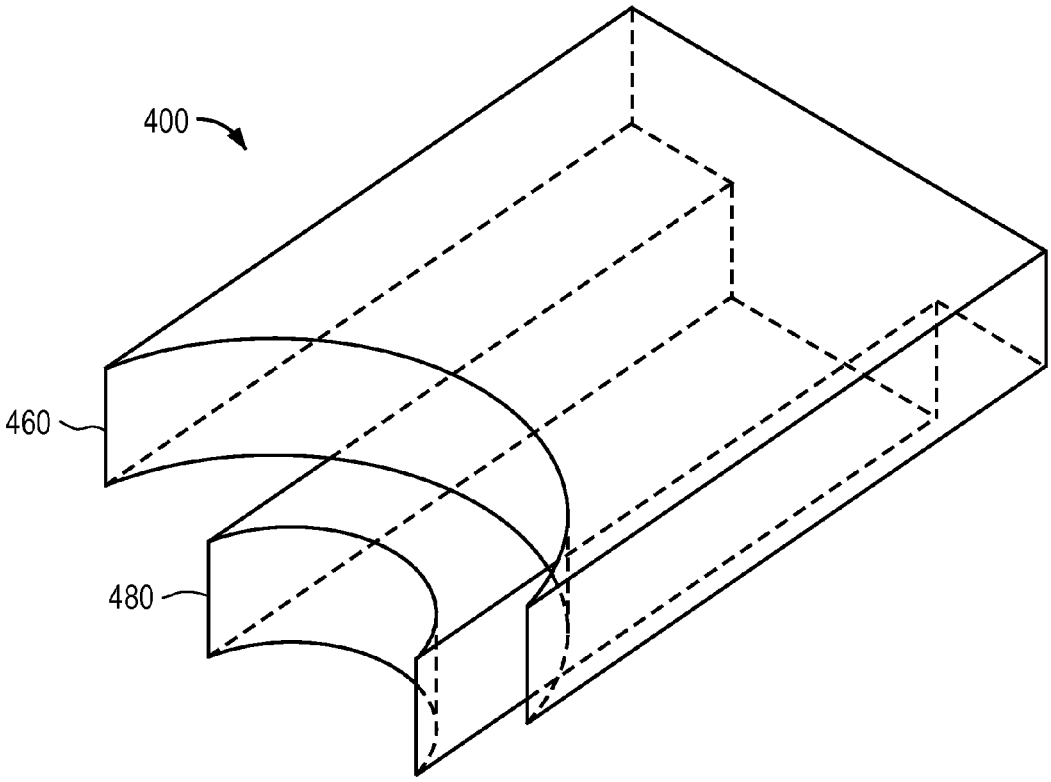
FIGS. 4A, 4B and 4C are isometric, bottom and front views of a half-moon insert to increase the contact area between the rim of the cartridge case and the barrel attachment.
Figure 4B:
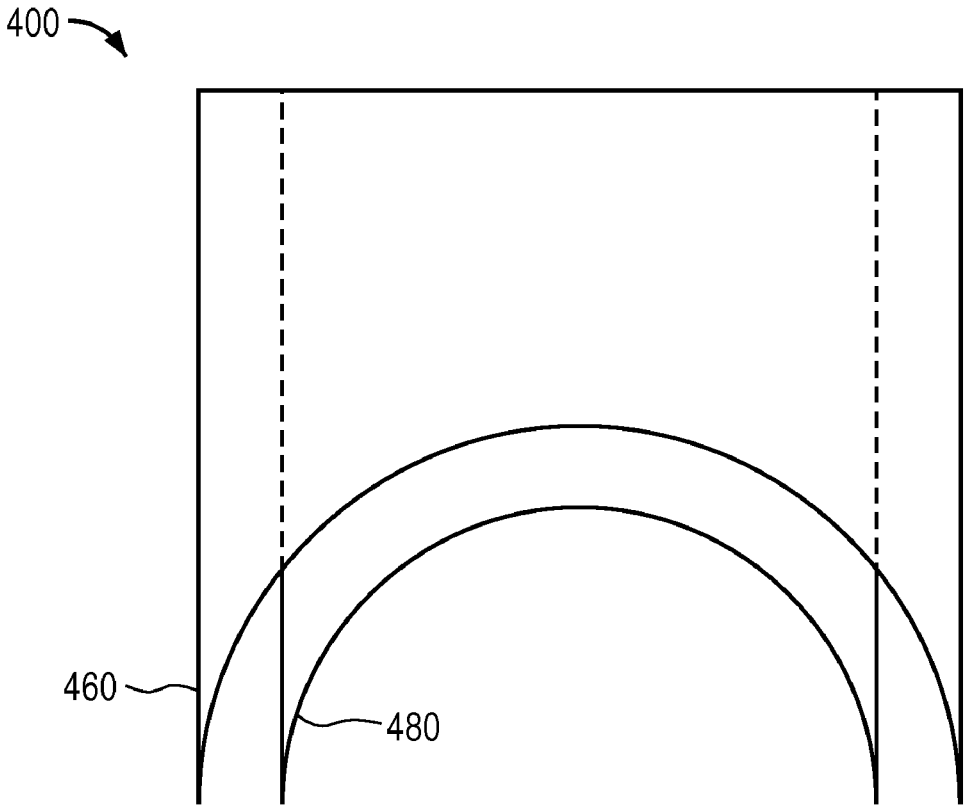
Figure 4C:
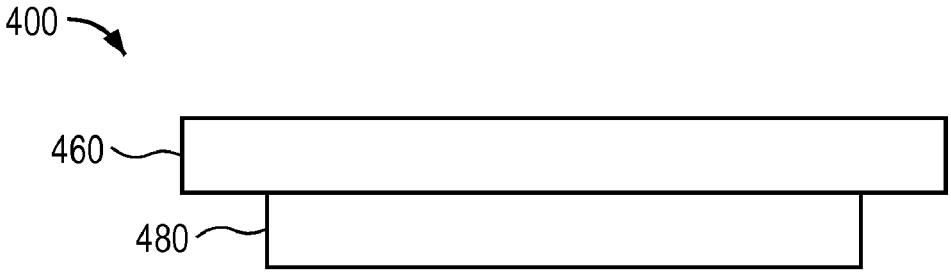

FIGS. 4A, 4B and 4C are an isometric view, a bottom view and a front view, respectively, of a half-moon insert 400 configured to further increase the contact area between the rim of a cartridge case and a corresponding barrel attachment (not shown in FIGS. 4A-4C), thereby minimizing the risk of deformation of the cartridge rim, since firearms cartridge cases are typically manufactured using a malleable alloy such as brass. Insert 400 comprises a stacked pair of half-moon sections 460, 480.

Referring also to FIGS. 1B and 1E, insert 400 is useful in combination with, for example, barrel attachment 100 and cartridge case 180. Larger-diameter half-moon section 460 is configured to slide into rim slot 110, after cartridge case 180 has been inserted. The larger-diameter half-moon section 460 stabilizes the rim 188 of cartridge case 180 against curved rim channel section 126, while the smaller-diameter half-moon section 480 provides additional load-bearing contact area opposite of curved rim channel section 126.

In some embodiments, half-moon insert 400 can be secured to a corresponding barrel attachment using a variety of mechanical devices (not shown) such as a spring-loaded ball-detent or a set screw. Insert 400 also serves to protect the rim slot of the barrel attachment from damage.

Figure 5A:
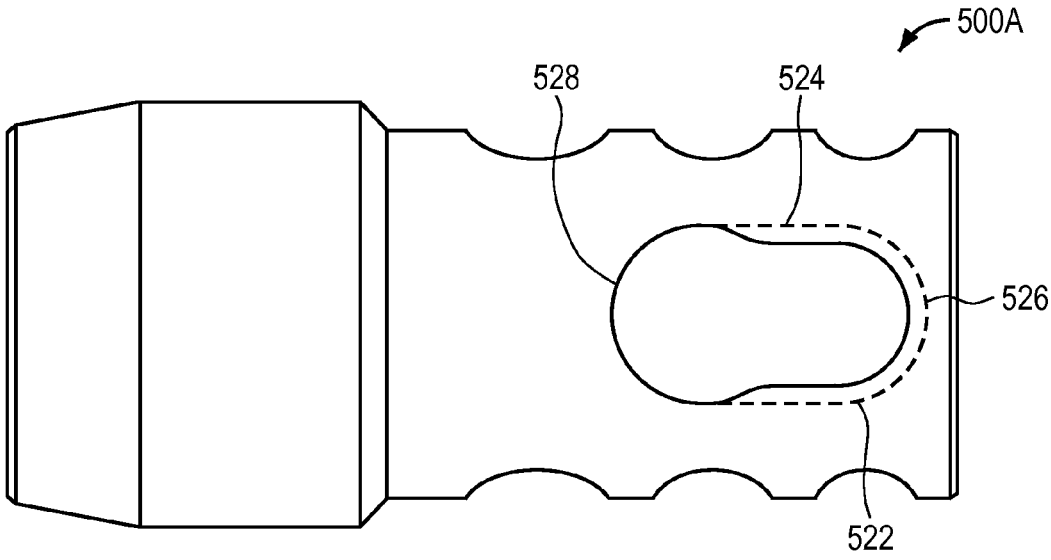
FIGS. 5A and 5B are bottom views of two additional exemplary embodiments of barrel attachments in accordance with the present invention.
Figure 5B:
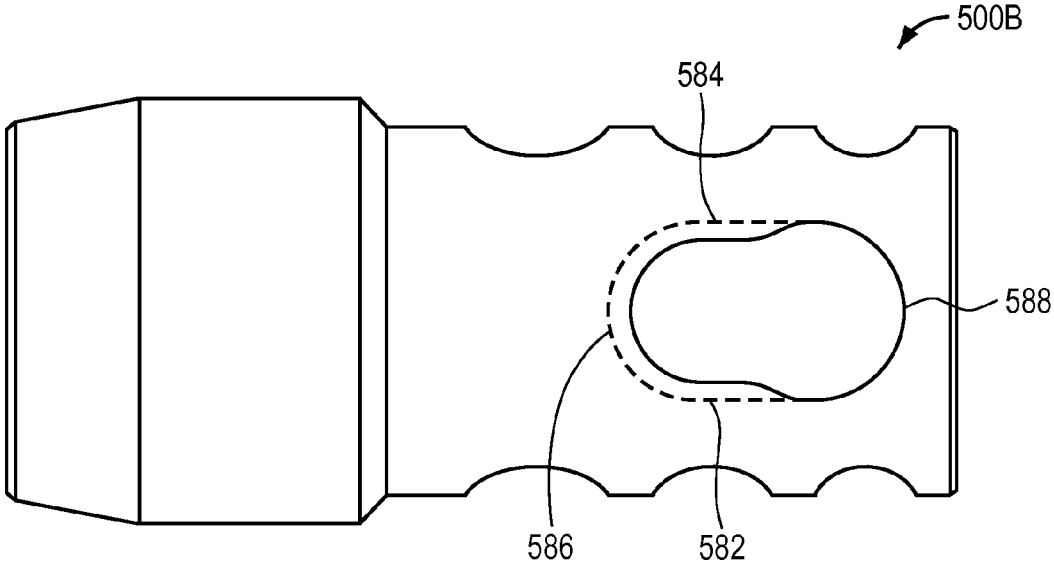

FIGS. 5A and 5B are bottom views of two additional exemplary barrel attachments 500A and 500B. Attachment 500A includes a blind rim slot having a curved entry recess 528 for inserting the rim of a cartridge (not shown). Curved entry recess 528 is adjacent to rim channel sections 522, 524. An additional curved rim channel section 526, adjacent to both rim channel sections 522, 524, provides increased contact area between barrel attachment 500A and the rim of the cartridge.

Similarly, attachment 500B includes a blind rim slot having a curved entry recess 588 adjacent to rim channel sections 582, 584. A curved rim channel section 586, adjacent to both rim channel sections 582, 584, provides additional contact area between barrel attachment 500B and the rim of a cartridge case (not shown).

Figure 6:
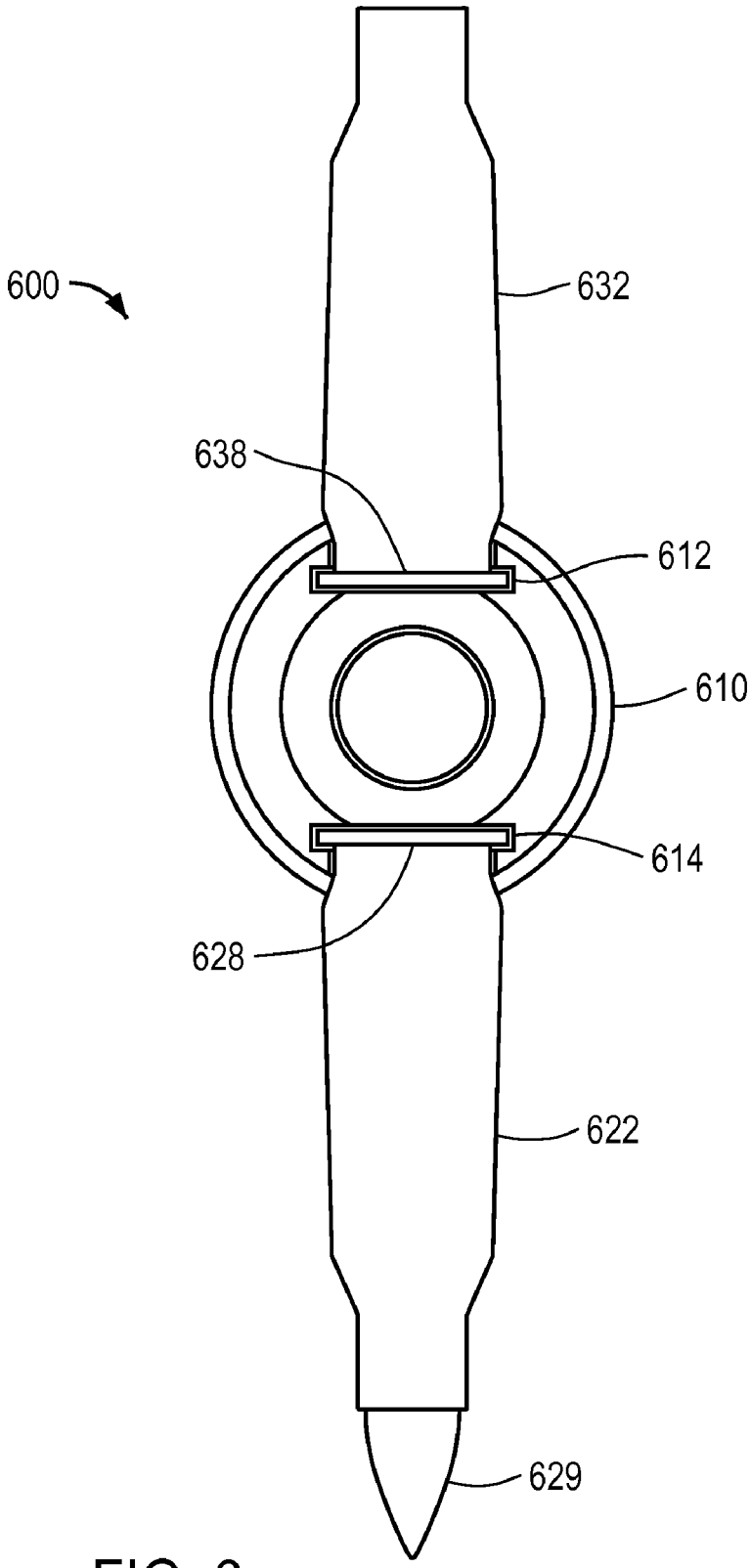
FIG. 6 is a front view of yet another embodiment of the present invention configured to accept multiple cartridge cases.

Referring now to FIG. 6, a front view of yet another embodiment, barrel attachment 610 includes rim slots 612, 714 configured to accept cartridge cases 632, 622, respectively, at two separate radial locations, 12 o'clock and 6 o'clock, relative to the bore of the barrel. In this example, cartridge cases 622, 632 enable attachment 610 to function in a manner similar to that of a T-handled wrench, thereby doubling the mechanical leverage available when compared with a barrel attachment configured to accept a single similarly sized cartridge case. Note that the various disclosed embodiments, including barrel attachment 610, can be further configured to include additional rim slots (not shown) to accept three or more cartridge cases, at multiple radial locations distributed around the bore axis of the barrel, for example, at 12 o'clock, 3 o'clock, 6 o'clock and 9 o'clock. It is also contemplated that barrel attachments with multiple cartridge capability, e.g., attachment 610, can be configured to accept multiple cartridges with similar and/or different case rim designs and/or rim sizes.

Figure 7:
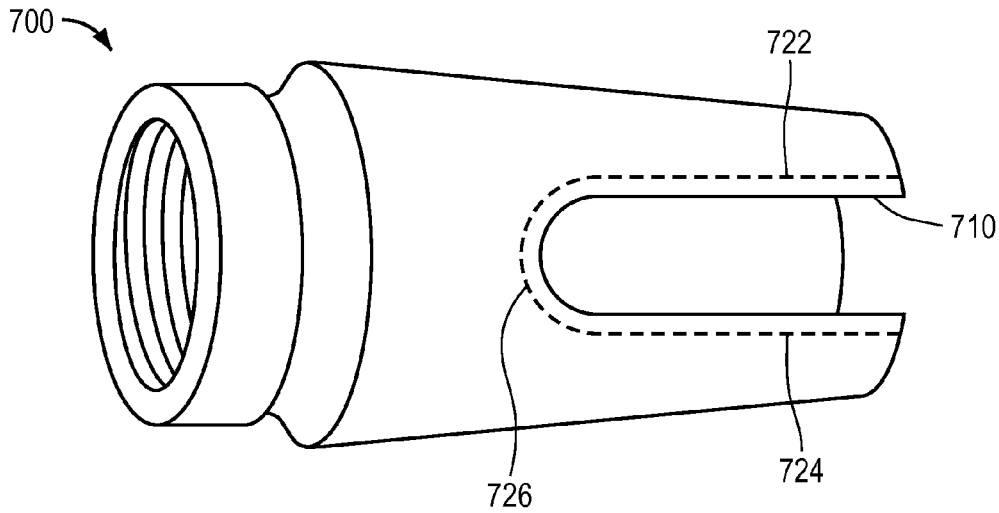
FIGS. 7 and 8 are isometric views of a multi-prong flash suppressor and a bird-cage flash suppressor, respectively, both configured to accept the rim of a cartridge case.

FIG. 7 is an isometric view of a multi-prong flash suppressor 700 (also commonly referred to as a flash hider) configured to accept the rim of a cartridge case (not shown). In this embodiment, the U-shaped cutout 710 between two adjacent suppressor prongs includes a curved rim channel section 726, and adjacent rim channel sections 722 and 724. Since carbonized deposits on suppressor 700 are expected from repeated firing, the dimensional tolerances of rim cutout 710 and channel width/depth of rim channel sections 722, 724, 726 should be appropriately relaxed.

Figure 8:
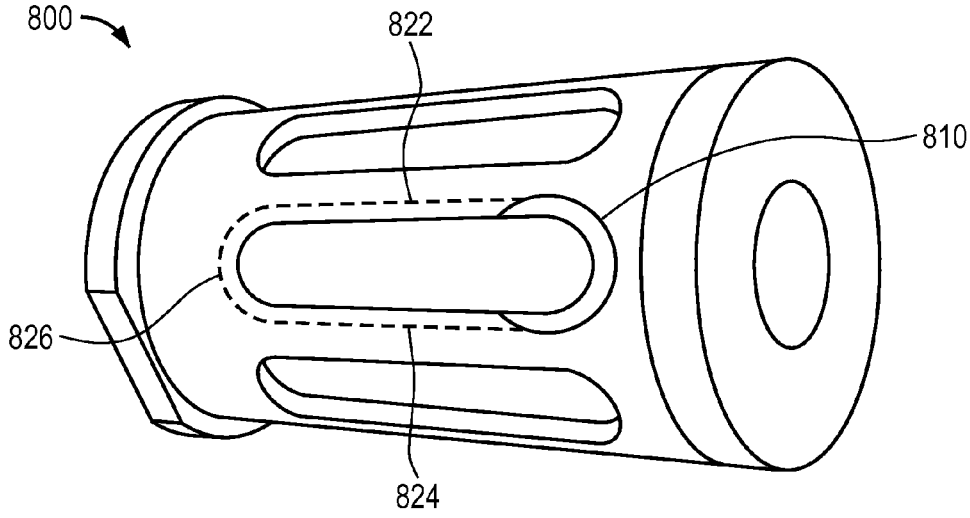

FIG. 8 is an isometric view of a bird-cage flash suppressor 800 configured to accept the rim of a cartridge case (not shown). In this embodiment, one of the through-slots of bird case suppressor 800 includes a curved ledge 810 for supporting and guiding the rim of the cartridge case during insertion. Curved ledge 810 is adjacent to rim channel sections 822, 824. In addition, a curved rim channel section 826, adjacent to both rim channel sections 822, 824, provides additional contact area between flash suppressor 800 and the rim of the cartridge case. Tolerances of curved ledge 810, and rim channels 822, 824, 826 should also be appropriately relaxed because of potential exposure to carbonized deposits.

Figure 9:
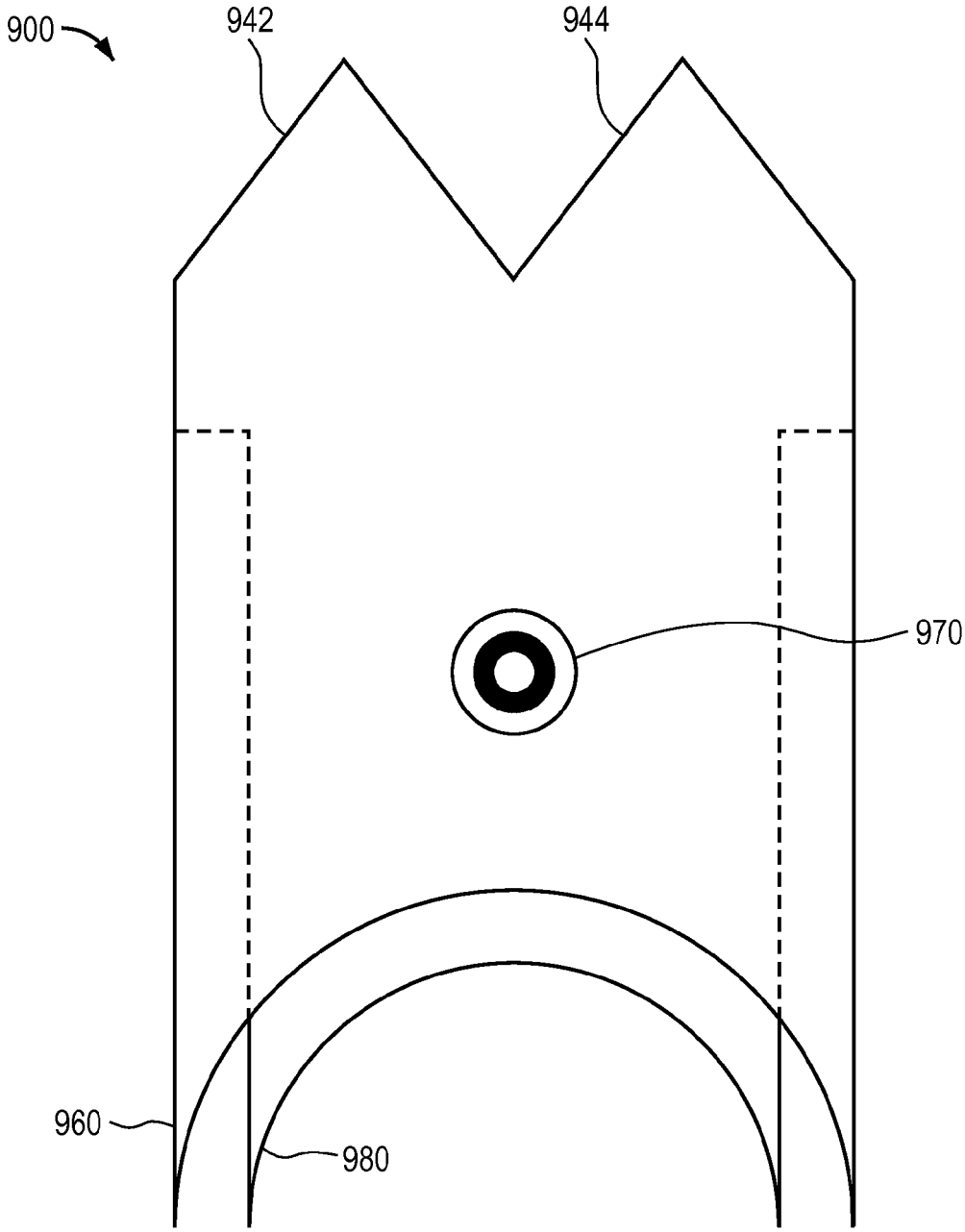
FIG. 9 is a bottom view of another exemplary half-moon insert configured to increase the contact area between the rim of the cartridge case and the barrel attachment, and further configured to provide impact force.

FIG. 9 is a bottom view of yet another embodiment, half-moon insert 900, configured to further increase the contact area between the rim of a cartridge case and the rim slot of a corresponding barrel attachment (not shown) in a manner similar to that of insert 400 described above, via a stacked pair of half-moon sections 960, 980. In this example, insert 900 also includes one or more impact points, e.g., points 942, 944, configured to provide focused impact forces capable of shattering glass targets, such as an automobile window. Insert 900 can be secured to a corresponding barrel attachment using a mechanical device 970, such as a spring-loaded ball-detent or a set screw. Such an impact force capability can be very useful for law enforcement applications.

Figure 10A:
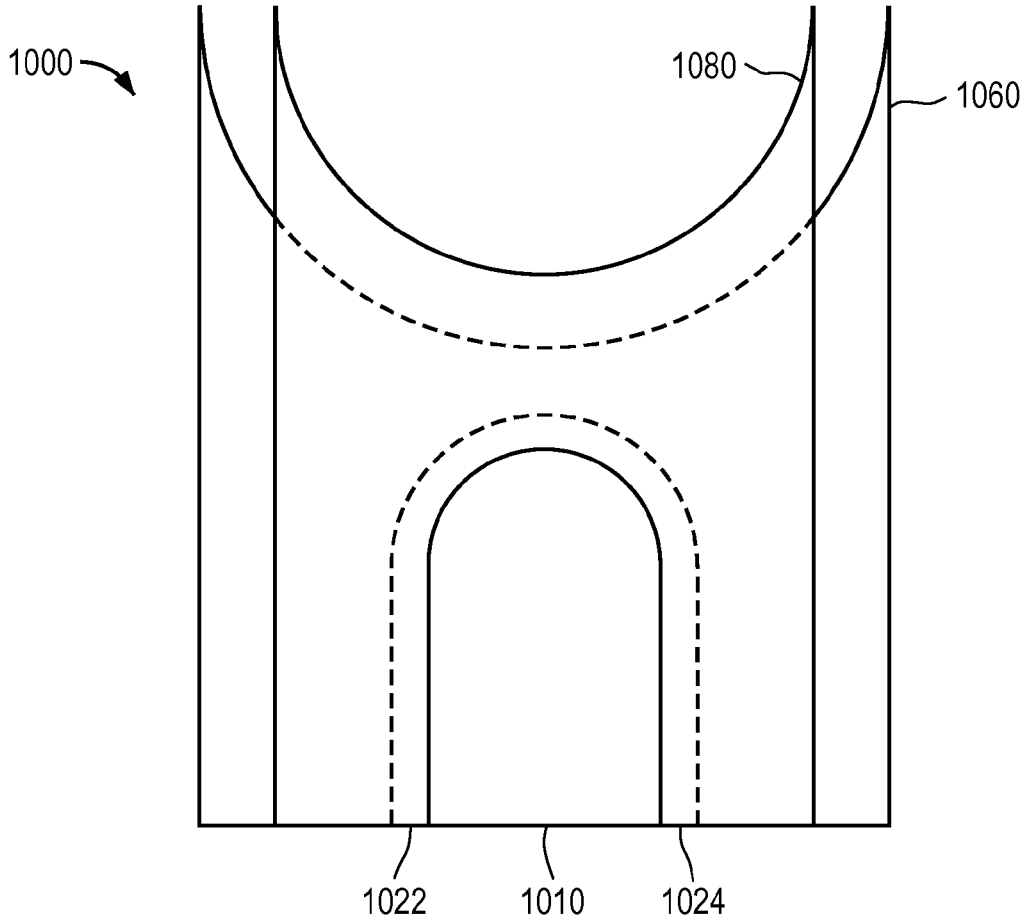
FIGS. 10A and 10B are top and front views of yet another half moon insert configured to increase the contact area between the rim of the cartridge case and the barrel attachment, and further configured to provide a rim slot for accepting an additional cartridge with smaller rim size.
Figure 10B:
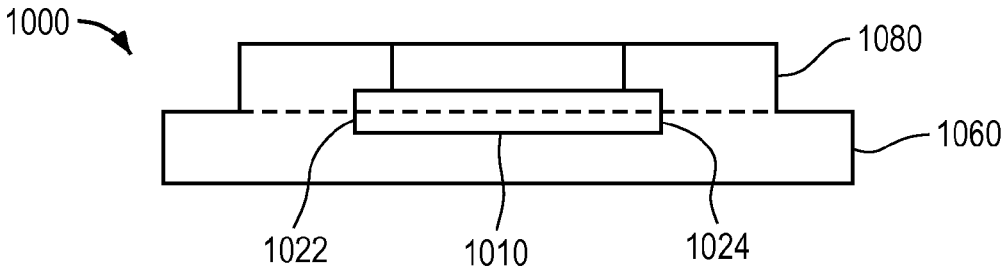

Referring now to FIGS. 10A and 10B, top and front views of yet another embodiment, half-moon insert 1000 is configured to increase the contact area between the rim of a cartridge case and a corresponding barrel attachment (not shown) in a manner similar to that of insert 400 described above. Insert 1000 further includes a rim slot 1010 with rim channel sections 1022, 1024 configured to accept a different cartridge with smaller rim size. Such an insert 1000 are especially useful for users with multiple firearms, such as a park warden, who may be issued with both a rifle and a sidearm such as 9×19 mm caliber pistol. For example, during a shift, a warden may elect to use the smaller pistol cartridge for better control and also perhaps to avoid any risk of rim deformation of a limited supply of the rifle ammunition.

Numerous other applications of the present invention are also possible. For example, while the exemplary embodiments of barrel attachments described include mainly muzzle brakes and flash suppressors, it is intended that the disclosed concepts of using a cartridge rim as a field tool are also applicable to compensators, barrel harmonic stabilizers such as harmonic dampeners and balancers, barrel-coupling protectors such as thread protectors and quick-detach coupling protectors, sound suppressors, projectile-launching attachments such as flare, smoke and flash-bang launchers, blank-firing attachments, sighting attachments such as laser sights, and also any combinations thereof.

In addition, the rim slots disclosed above can be adapted to accept other firearm accessories such as picatinny rails, bayonet mounts, flashlight mounts, and barrel supports such as bipods and monopods. A specialized steel tool with a variety of changeable cartridge rim ends can also be issued as part of a gunsmith's tool kit.

In sum, the present invention provides systems and methods for using firearm cartridge cases to provide additional mechanical leverage for installing or removing barrel attachments without the need for specialized tools. These exemplary systems and methods disclosed are intended to be practiced alone or in combination.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A barrel attachment useful in association with a firearm barrel, the barrel attachment comprising:

a coupling section configured to attach the barrel attachment to a firearm barrel; and a rim channel configured to engage at least one portion of a rim of a cartridge case, and wherein the rim channel is configured to enable the engaged cartridge case to provide leverage for rotating the barrel attachment substantially around a bore axis of the firearm barrel.

2. The barrel attachment of claim 1 wherein the rim channel is an integral portion of a cartridge rim slot of the barrel attachment.

3. The barrel attachment of claim 2 wherein the rim slot is substantially parallel to the bore axis of the firearm barrel.

4. The barrel attachment of claim 2 further comprising a half-moon insert configured to be inserted into the rim slot thereby increase contact area between the rim of the cartridge case and the barrel attachment.

5. The barrel attachment of claim 4 wherein the half-moon insert is further configured to provide an impact force.

6. The barrel attachment of claim 1 wherein the rim channel includes a curved rim channel portion corresponding to the radius of the rim of the cartridge case.

7. The barrel attachment of claim 1 further comprising a second rim channel configured to engage at least one portion of a rim of a second cartridge case, and wherein the second rim channel is configured to enable the second engaged cartridge case to provide additional leverage for rotating the barrel attachment substantially around the bore axis of the firearm barrel.

8. The barrel attachment of claim 1 wherein the rim of the cartridge case is within a range of rim sizes.

9. The barrel attachment of claim 1 wherein the rim of the cartridge case is one of at least two rim sizes.

10. The barrel attachment of claim 1 wherein the barrel attachment is one of a flash suppressor, a muzzle brake, a compensator, a barrel harmonic stabilizer, a barrel-coupling protector, a sound suppressor, a projectile-launching attachment, a blank-firing attachment and a sighting attachment.

11. A method for providing leverage for rotating a barrel attachment useful in association with a firearm barrel and a cartridge case, the method comprising:

engaging a rim of a cartridge case with a rim channel of a barrel attachment attached to a firearm barrel; and applying a force on the cartridge case engaged to the barrel attachment thereby causing the barrel attachment to rotate around a bore axis of the firearm barrel.

12. The method of claim 11 wherein the rim channel is an integral portion of a cartridge rim slot of the barrel attachment.

13. The method of claim 12 wherein the rim slot is substantially parallel to the bore axis of the firearm barrel.

14. The method of claim 12 further comprising increasing contact area between the rim of the cartridge case and the barrel attachment by sliding a half-moon insert into the rim slot.

15. The method of claim 14 wherein the half-moon insert is further configured to provide an impact force.

16. The method of claim 11 wherein the rim channel includes a curved rim channel portion corresponding to the radius of the rim of the cartridge case.

17. The method of claim 11 further comprising engaging a rim of a second cartridge case with a second rim channel of the barrel attachment, and wherein the second rim channel is configured to enable the second engaged cartridge case to provide additional leverage for rotating the barrel attachment substantially around the bore axis of the firearm barrel.

18. The method of claim 11 wherein the rim of the cartridge case is within a range of rim sizes.

19. The method of claim 11 wherein the rim of the cartridge case is one of at least two rim sizes.

20. The method of claim 11 wherein the barrel attachment is one of a flash suppressor, a muzzle brake, a compensator, a barrel harmonic stabilizer, a barrel-coupling protector, a sound suppressor, a projectile-launching attachment, a blank-firing attachment and a sighting attachment.

* * * * *